US007685648B2

(12) United States Patent
Kenney

(10) Patent No.: US 7,685,648 B2
(45) Date of Patent: Mar. 30, 2010

(54) BATH TOWEL BIB

(76) Inventor: Mary Kenney, 13885 87th St., West Palm Beach, FL (US) 33412

( * ) Notice: Subject to any disclaimer, the term of this patent is extended or adjusted under 35 U.S.C. 154(b) by 0 days.

(21) Appl. No.: 12/220,152

(22) Filed: Jul. 22, 2008

(65) Prior Publication Data

US 2010/0017929 A1 Jan. 28, 2010

(51) Int. Cl.
*A41D 13/04* (2006.01)

(52) U.S. Cl. ..... 2/48; 2/52

(58) Field of Classification Search ..... 2/48, 2/52, 51, 49.1–49.5, 207, 88, 463, 92, 102, 2/46, 69, 69.5, 50; D2/861–864
See application file for complete search history.

(56) References Cited

U.S. PATENT DOCUMENTS

| | | | | | |
|---|---|---|---|---|---|
| 2,423,002 | A | * | 6/1947 | Bray | 2/52 |
| D149,092 | S | * | 3/1948 | Seidenbaum | D2/861 |
| 2,441,745 | A | | 5/1948 | Benamy | |
| 2,464,007 | A | * | 3/1949 | Towle | 2/91 |
| 2,501,010 | A | * | 3/1950 | Seidenbaum | 2/48 |
| 2,722,685 | A | * | 11/1955 | Lucas | 2/48 |
| 2,879,514 | A | * | 3/1959 | Shapiro | 2/48 |
| 3,084,346 | A | | 4/1963 | Stelter | |
| 3,629,865 | A | | 12/1971 | Weiner | |
| 4,014,045 | A | * | 3/1977 | Moyer | 2/51 |
| 4,321,709 | A | * | 3/1982 | Steinberg | 2/207 |
| D275,827 | S | | 10/1984 | Henry | |
| 4,685,154 | A | | 8/1987 | Smith | |
| D311,087 | S | | 10/1990 | Pickard | |
| D343,498 | S | * | 1/1994 | Donahue | D2/864 |
| D366,556 | S | * | 1/1996 | Wilson | D2/861 |
| 5,611,095 | A | | 3/1997 | Schneider | |
| 5,722,094 | A | | 3/1998 | Ruefer | |
| D398,140 | S | | 9/1998 | Lion | |
| 5,950,235 | A | | 9/1999 | Tata | |
| D456,661 | S | | 5/2002 | Henegan | |
| 6,389,597 | B1 | | 5/2002 | Henegan | |
| 6,536,047 | B1 | | 3/2003 | Mullaly | |
| 6,594,829 | B1 | | 7/2003 | Turkheimer | |
| 6,836,899 | B1 | * | 1/2005 | Glasmire | 2/52 |
| 6,865,749 | B2 | * | 3/2005 | Mohney | 2/48 |
| 6,868,566 | B2 | | 3/2005 | Gatten | |
| 2003/0079267 | A1 | | 5/2003 | Dugan | |
| 2006/0143769 | A1 | * | 7/2006 | Pathak et al. | 2/48 |

OTHER PUBLICATIONS

Clevamama Baby Bath Towel, http://www.boohoobaby.co.uk, accessed on Aug. 15, 2007.
The Original Cuddledry Baby Bath Towel, http://www.cuddledry.com, accessed on Aug. 15, 2007.

* cited by examiner

*Primary Examiner*—Amy B Vanatta
(74) *Attorney, Agent, or Firm*—Nancy J. Flint

(57) ABSTRACT

A bath towel bib including a collar adapted to form a releasably securable loop around a user's neck, an actuatable means for releasing the loop from around the user's neck, and an absorbent cloth fixedly attached to the collar and operatively arranged to hang from the collar in front of the user's torso when the loop is releasably secured around the user's neck, wherein the actuatable means for releasing the loop from around the user's neck is operatively arranged to actuate when the absorbent cloth is pulled in a direction away from the user's neck.

8 Claims, 10 Drawing Sheets

BATH TOWEL BIB

FIELD OF THE INVENTION

The invention generally relates to bath towels and bibs. In particular, the invention relates to a combination bath towel and bib, which is particularly adapted for bathing infants.

BACKGROUND OF THE INVENTION

Bathing can be an important bonding experience for a parent and her infant. The tactile sensation the infant receives as the parent washes its body is stimulating and helps develop their relationship. It is desirable for a parent to utilize both her hands as she washes her infant to maximize the effect. Moreover, when the infant is especially young, for example, when the infant is a newborn baby, the parent needs both hands free to cradle the infant's head and maneuver its body. Bathing can also be a messy experience for a parent. This is especially the case with older infants, who tend to play and splash water everywhere.

Once bathing is complete, the wet parent generally will reach for a nearby towel, throw the towel over her shoulder or pin it between her chin and chest, in order to free her hands to reach for the infant, and then lift the wet infant from the bath and start wrapping it in the towel. This process usually requires the adjustment of the infant in the towel, or worse yet, it requires laying the infant down on a changing table or bed, spreading open the towel, which can chill the wet infant, and subsequently rewrapping it in the towel. The chilling of a wet infant can lead to a crying wet infant, which can lead to the infant forming negative associations with bathing, thereby undercutting what should be a meaningful bonding experience between the parent and her infant.

Therefore, there is a long-felt need for a means for maintaining dryness while bathing an infant. There is also a long-felt need for a bath towel which is arranged to receive an infant from a bath, while allowing a parent to keep her hands free.

BRIEF SUMMARY OF THE INVENTION

Broadly, the present invention is a bath towel bib including a collar adapted to form a releasably securable loop around a user's neck, an actuatable means for releasing the loop from around the user's neck, and an absorbent cloth fixedly attached to the collar and operatively arranged to hang from the collar in front of the user's torso when the loop is releasably secured around the user's neck, wherein the actuatable means for releasing the loop from around the user's neck is operatively arranged to actuate when the absorbent cloth is pulled in a direction away from the user's neck.

Various embodiments of the actuatable means for releasing the loop from around the user's neck are contemplated, as shown and described herein. Regardless of the embodiments, however, such means provides the user with the ability to use both her hands to bath an infant, wrap the wet infant in the absorbent cloth hanging from her neck in front of her torso, and pull the collar off simply by pulling the absorbent cloth, with the infant wrapped therein, in a direction away from her neck.

It is an object of the present invention to provide a means for maintaining dryness while bathing an infant.

It also an object of the invention to provide a bath towel which is arranged to receive an infant from a bath, while allowing a parent to keep her hands free.

These and other objects and advantages of the present invention will be readily appreciable from the following description of preferred embodiments of the invention and from the accompanying drawings and claims.

BRIEF DESCRIPTION OF THE DRAWINGS

The nature and mode of operation of the present invention will now be more fully described in the following detailed description of the invention taken with the accompanying drawing figures, in which.

DETAILED DESCRIPTION OF THE INVENTION

At the outset, it should be appreciated that like drawing numbers on different is drawing views identify identical, or functionally similar, structural elements of the invention. While the present invention is described with respect to what is presently considered to be the preferred aspects, it is to be understood that the invention as claimed is not limited to the disclosed aspects.

Furthermore, it is understood that this invention is not limited to the particular methodology, materials and modifications described and as such may, of course, vary. It is also understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. Although any methods, devices or materials similar or equivalent to those described herein can be used in the practice or testing of the invention, the preferred methods, devices, and materials are now described.

Figure 1:
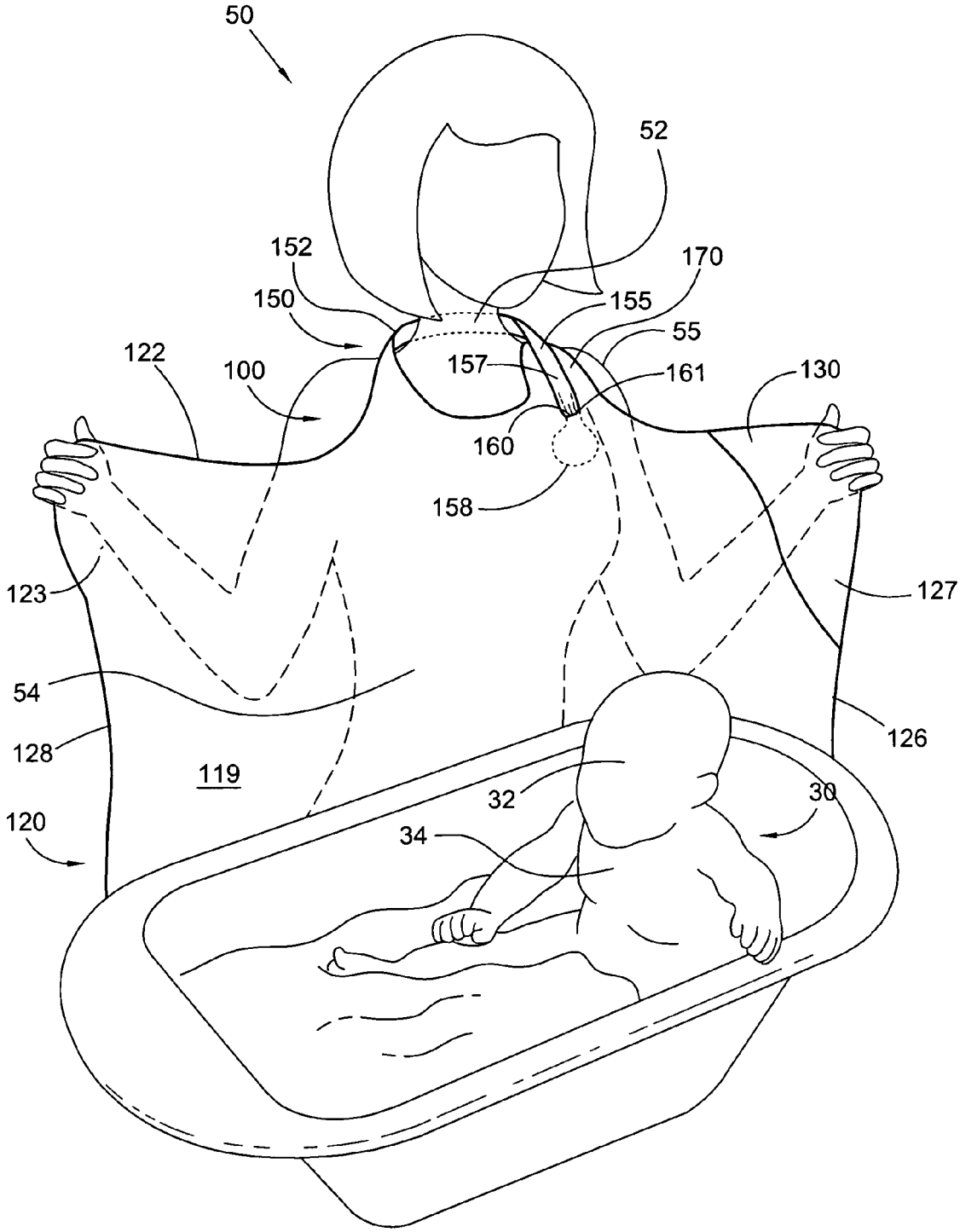
FIG. 1 is a front perspective view of a user displaying a first embodiment of the present invention bath towel bib while bathing an infant.

The following description is best understood in view of FIGS. 1-5. FIG. 1 is a front perspective view of user 50 displaying a first embodiment of present invention bath towel bib 100 while bathing infant 30. User 50 includes neck 52, torso 54, and shoulder 55. Infant 30 includes head 32 and body 34. Hereinafter, the term "actuate" means to be put into mechanical action or motion, and the term "actuatable" means to have the ability to be actuated.

Figure 5:
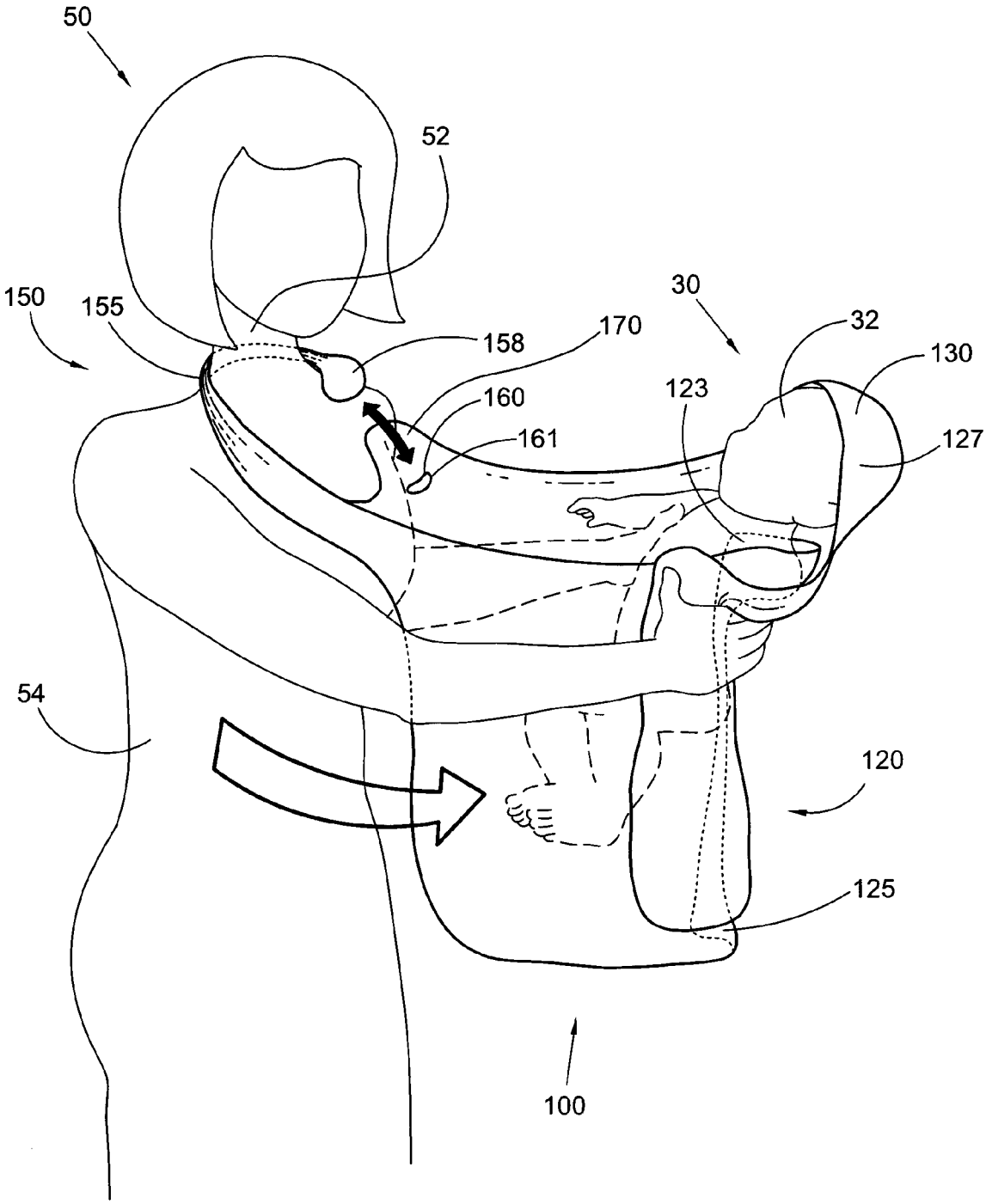
FIG. 5 is a front perspective view of a fourth step in utilizing the bath towel bib, showing the user pulling the absorbent cloth away from her neck.

Bath towel bib 100 comprises collar 150 adapted to form releasably securable loop 152 around neck 52, an actuatable means for releasing loop 152 from around neck 52, and absorbent cloth 120 fixedly attached to collar 150. Absorbent cloth 120 is operatively arranged to hang from collar 150 in front of torso 54 when loop 152 is releasably secured around neck 52. The actuatable means for releasing loop 152 from around neck 52 is operatively arranged to actuate when absorbent cloth 120 is pulled in a direction away from neck 52, as shown in FIG. 5 and described in further detail infra.

Figure 4:
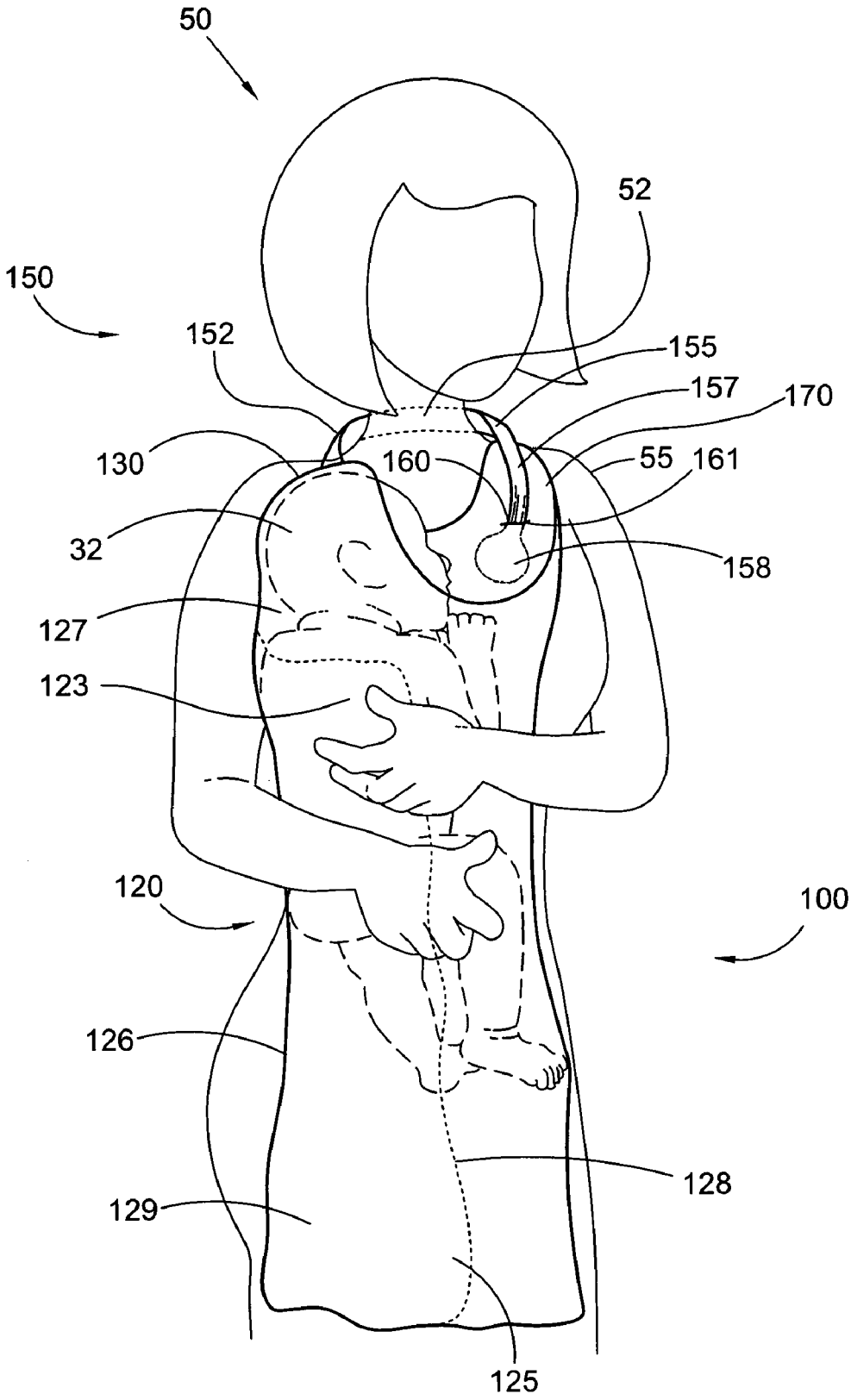
FIG. 4 is a front perspective view of a third step in utilizing the bath towel bib, showing the user covering the infant's head with the hood.

Absorbent cloth 120 comprises any suitable absorbent cloth, for example, linen or terrycloth. As shown in the figures, absorbent cloth 120 includes front surface 119 and may be substantially rectangular. If rectangular, it generally comprises first upper corner region 123, second upper corner region 127, first lower corner region 125, and second lower corner region is 129, as well as upper edge 122, lower edge 124, first side edge 128, and second side edge 126. In a preferred embodiment, first and/or second upper corner regions, 123 and/or 127, respectively, comprises hood 130. Hood 130 is operatively arranged to cover head 32 of infant 30 as shown in FIGS. 4 and 5. Regardless of the embodiment, absorbent cloth 120 is adapted to substantially cover and/or shield the front of the user's torso when it is arranged hangingly from collar 150. This hanging arrangement also allows user 50 to keep both of her hands free while she is bathing infant 30.

Absorbent cloth 120 may further comprise extension 170 which is adapted to rest on one of the user's shoulders. Extension 170 may be an extension of the material from which absorbent cloth 120 is made, or a separate piece of material fixedly secured to such material. Extension 170 is arranged, in part, to stabilize bath towel bib 100 on user 50.

In its first embodiment, as shown in FIGS. 1-5, bath towel bib 100 further comprises aperture 160 having inner surface 161, and loop 152 comprises strap 155 extending from absorbent cloth 120 proximate a first side of the user's neck 52. This embodiment includes extension 170 adapted to rest on the user's shoulder on the side of the user's neck 52 opposite the first side. Strap 155 includes first end 158 and outer surface 157. First end 158 is insertable in aperture 160. While aperture 160 may be arranged anywhere on bath towel bib 100 within reach of first end 158, in this embodiment, aperture 160 is arranged on absorbent cloth 120 proximate extension 170. In this embodiment, the actuatable means for releasing loop 152 from around neck 52 comprises a frictional engagement between outer surface 157 and inner surface 161, when first end 156 is arranged in aperture 160.

The aforementioned frictional engagement comprises a static friction sufficient to maintain the form of loop 52 around neck 52 when absorbent cloth 120 hangs from collar 150 in front of the user's torso 54, but insufficient to maintain the form of loop 52 when absorbent cloth 120 is pulled in a direction away from the user's neck 52, as shown in FIG. 5. In a preferred embodiment, as shown in the figures, first end 158 is larger than aperture 160 in order to provide ample static friction to maintain the form of loop 52 around neck 52. An enlarged first end 158, relative to aperture 160, is particularly advantageous when the weight of absorbent cloth 120 increases as it absorbs water during use.

FIGS. 2-5 show a preferred method of utilizing bath towel bib 100. While these particular figures only show the first embodiment of the present invention bath towel bib, the method described hereinbelow generally applies to all of its embodiments, including those shown in FIGS. 6-10, as well as any other embodiments within the scope and spirit of the invention.

Figure 2:
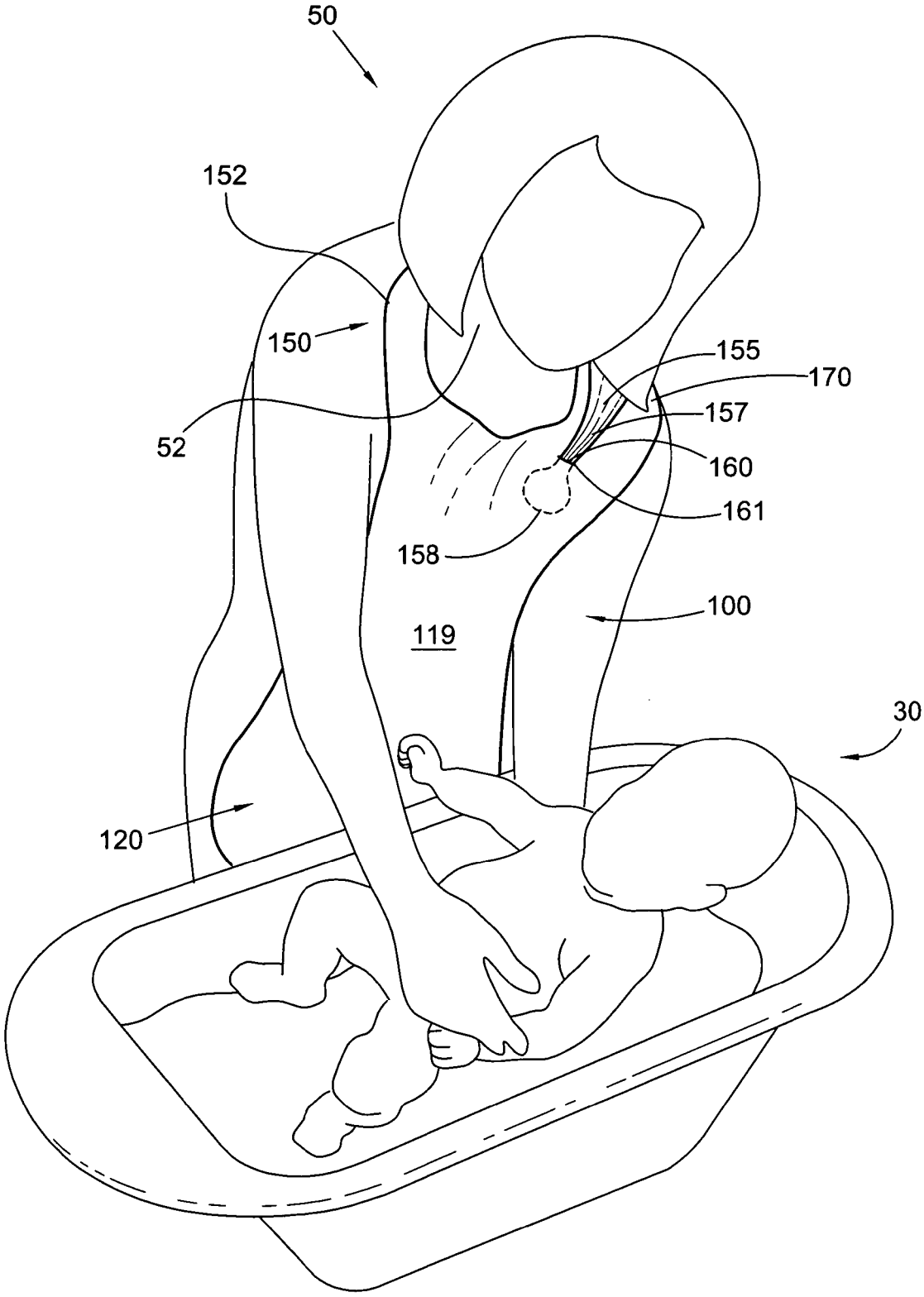
FIG. 2 is a front perspective view of a first step in utilizing the bath towel bib, showing the user picking up the wet infant.

The first step is illustrated in FIG. 2, which shows user 50 with collar 150 forming loop 152, releasably secured around her neck 52, from which absorbent cloth 120 hangs in front of her torso 54, shielding her from the bath water. In this figure, user 50 is beginning to lift infant 30 from the bath.

Figure 3:
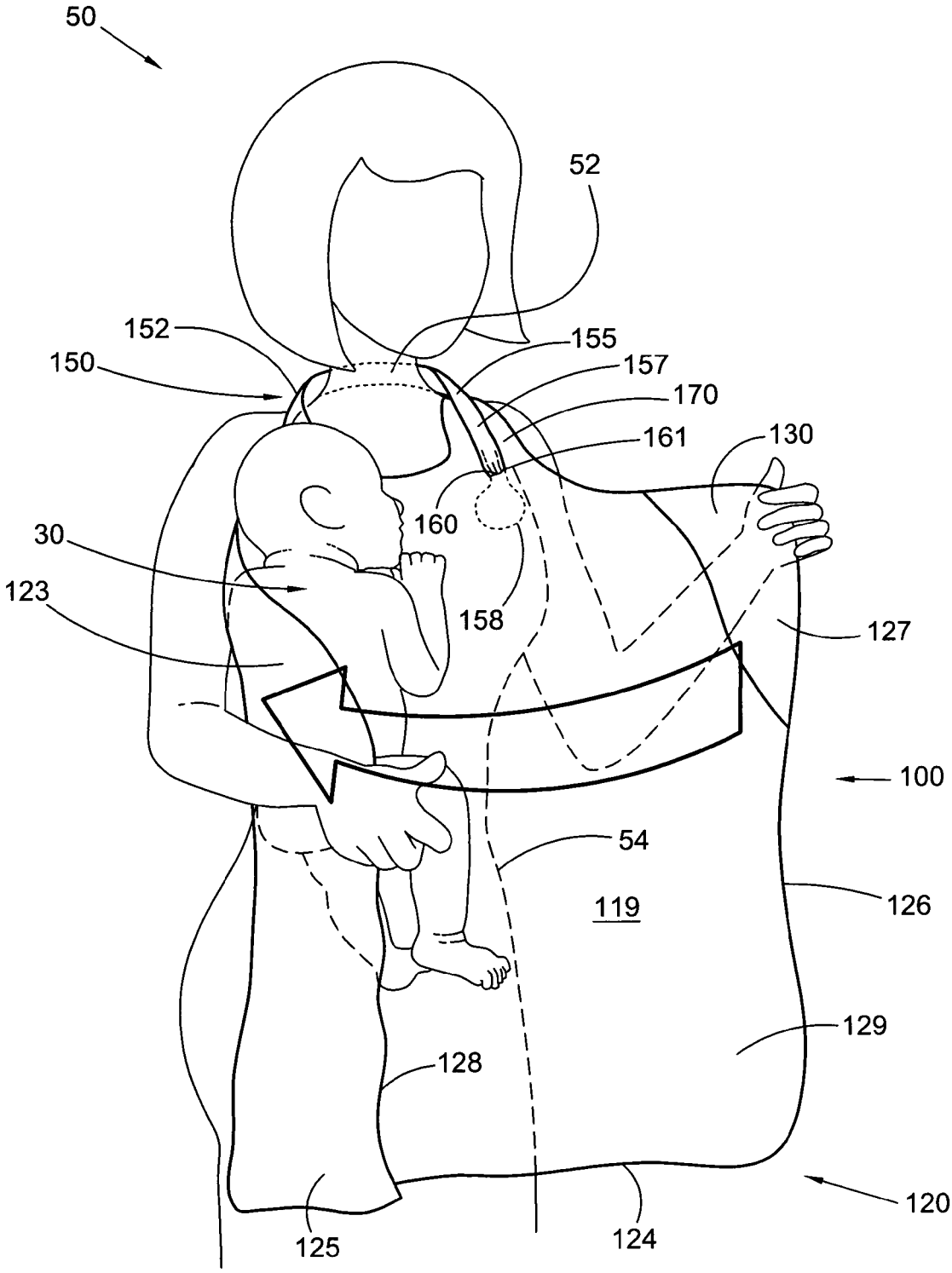
FIG. 3 is a front perspective view of a second step in utilizing the bath towel bib, showing the user holding the infant within a first upper corner region of an absorbent cloth of the bath towel bib and beginning to bring a second upper corner region comprising a hood toward the infant's head.

The second step is illustrated in FIG. 3, which shows user 50 holding in one arm infant 30 against front surface 119 and within a folded first upper corner region 123. With her free hand, user 50 is shown holding second upper corner region 127, which comprises hood 130, as she is preparing to bring hood 130 toward head 32 of infant 30, which is illustrated by the arrow. FIG. 4 illustrates the third step, wherein user 50 has infant 30 still wrapped within first upper corner region 123, as shown in FIG. 3, and further wrapped within second upper corner region 127 with hood 130 covering the infant's head 32.

FIG. 5 illustrates the fourth step, wherein user 50 user pulls absorbent cloth 120 in a direction away from her neck 52, as indicated by the arrow pointing away from her neck. As shown in the figure, infant 30 remains snuggly within the folds of absorbent cloth 120 during this step. As described supra, the actuatable means for releasing loop 152 from around the user's neck 52 comprises a frictional engagement between outer surface 157 of strap 155 and inner surface 161 of aperture 160, when first end 156 is arranged therein. The static friction of the frictional engagement, when first end 158 is at rest within aperture 160, is sufficient to maintain the form of loop 52 around neck 52. However, the static friction is insufficient to maintain the form of loop 52 when user 50 pulls absorbent cloth 120 in a direction away from her neck 52, as illustrated by the double-headed arrow showing first end 158 and aperture 160 being pulled apart, thereby releasing the user's neck 52 from loop 152. When the entirety of bath towel bib 100 is pulled away from user 50, after the completion of the fourth step, infant 30 is wrapped within bath towel bib 100.

Figure 6:
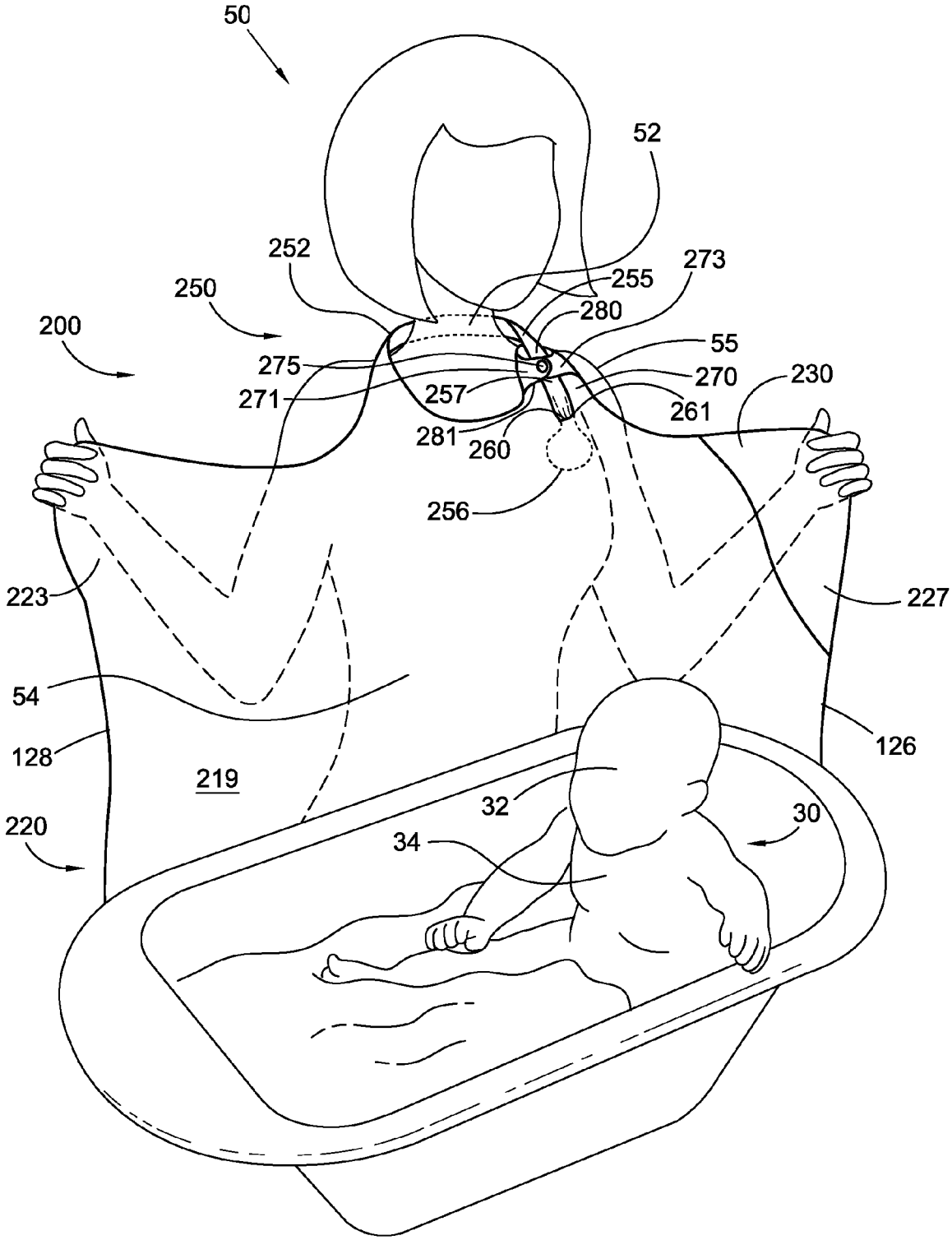
FIG. 6 is a front perspective view of a user displaying a second embodiment of the present invention bath towel bib while bathing an infant.

FIG. 6 is a front perspective view of user 50 displaying a second embodiment of the present invention bath towel bib, hereinafter referred to as bath towel bib 200. Similar to bath towel bib 100, bath towel bib 200 comprises collar 250 adapted to form releasably securable loop 252 around the user's neck 52, an actuatable means for releasing loop 252 from around the user's neck 52, and absorbent cloth 220 fixedly attached to collar 250. Absorbent cloth 220 is operatively arranged to hang from collar 250 in front of the user's torso 54 when loop 252 is releasably secured around the user's neck 52. The actuatable means for releasing loop 252 from around neck 52 is operatively arranged to actuate when absorbent cloth 220 is pulled in a direction away from neck 52, similar to that which is shown in FIG. 5 and described in detail supra.

Absorbent cloth 220 may comprise any suitable absorbent cloth. As shown in the figures, absorbent cloth 220 includes front surface 219 and may be substantially rectangular. If rectangular, absorbent cloth 220 generally comprises first upper corner region 223, second upper corner region 227, a first lower corner region (not shown), and a second lower corner region (not shown). In a preferred embodiment, first and/or second upper corner regions, 223 and/or 227, respectively, comprises hood 230. Hood 230 is operatively arranged to cover head 32 of infant 30. Absorbent cloth 220 is adapted to substantially cover and/or shield the front of the user's torso 54 when it is arranged hangingly from collar 250. This hanging arrangement also allows user 50 to keep both of her hands free while she is bathing infant 30.

Absorbent cloth 220 further comprises extension 270, which is adapted to rest on a shoulder of user 50. Extension 270 may be an extension of the material from which absorbent cloth 220 is made, or a separate piece of material fixedly secured to such material. Bath towel bib 200 further comprises first aperture 260 and second aperture 280. First aperture 260 is arranged on absorbent cloth 220 proximate extension 270 and includes first inner surface 261. Extension 270 forms second aperture 280, which includes second inner surface 281. Preferably, as shown in FIG. 6, second aperture 280 is arranged as a tube, which may be in the form of at least two flaps, 271 and 273. Flaps 271 and 273 are arranged to fold over and be secured to each other. They may be secured to each other by any suitable means known in the art, for example, snap button 275, hook-and-loop fasteners, stitching, etc.

Loop 252 comprises strap 255 extending from absorbent cloth 220 proximate a first side of the user's neck 52. Strap 255 includes first end 256 and outer surface 257. First end 256 is insertable in first aperture 260 and second aperture 280. In this embodiment, the actuatable means for releasing loop 252 from around the user's neck 52 comprises a first frictional engagement between outer surface 257 and first inner surface 261, and a second frictional engagement between outer surface 257 and second inner surface 281, when first end 256 is arranged in first and second apertures 260 and 280, respectively.

Each of the first and second frictional engagements may comprise a static friction sufficient to maintain the form of loop 252 around the user's neck 52 when absorbent cloth 220 hangs from collar 250 in front of the user's torso 54. In the alternative, the first and second frictional engagements may be designed such that both are required to maintain the form of loop 252 around the user's neck 52 under such conditions. Regardless, both the first and second frictional engagements are insufficient, alone and in combination, to maintain the form of loop 252 when absorbent cloth 220 is pulled in a direction away from the user's neck 52. Preferably, first end 256 is larger than at least first aperture 260, and possibly second aperture 280, in order to provide ample static friction to maintain the form of loop 252 around the user's neck 52.

Figure 7:
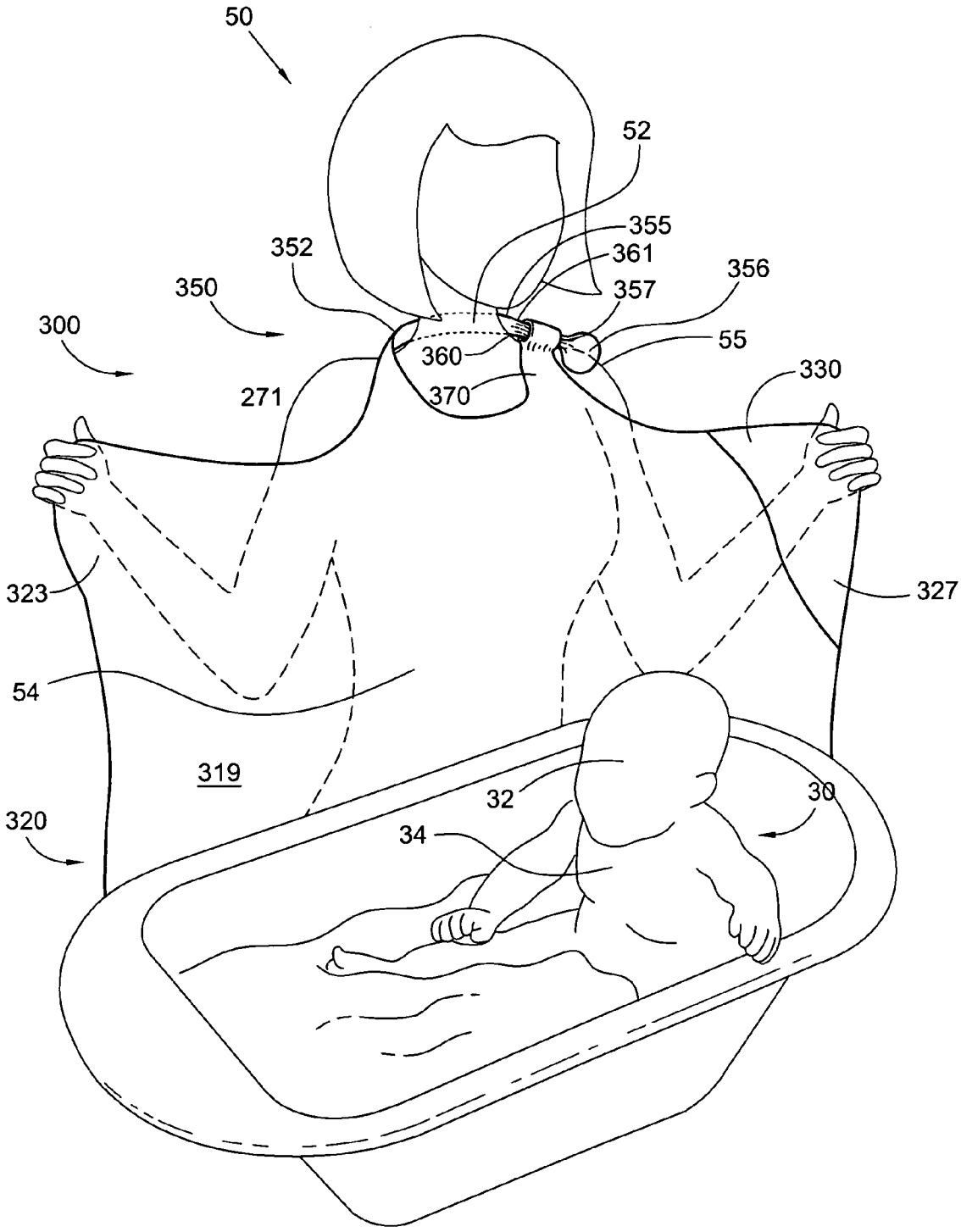
FIG. 7 is a front perspective view of a user displaying a third embodiment of the present invention bath towel bib while bathing an infant.

FIG. 7 is a front perspective view of user 50 displaying a third embodiment of the present invention bath towel bib, hereinafter referred to as bath towel bib 300. Bath towel bib 300 comprises collar 350 adapted to form releasably securable loop 352 around the user's neck 52, an actuatable means for releasing loop 352 from around the user's neck 52, and absorbent cloth 320 fixedly attached to collar 350. Absorbent cloth 320 is operatively arranged to hang from collar 350 in front of the user's torso 54 when loop 352 is releasably secured around the user's neck 52. The actuatable means for releasing loop 352 from around neck 52 is operatively arranged to actuate when absorbent cloth 320 is pulled in a direction away from the user's neck 52, similar to that which is shown in FIG. 5 and described in detail supra.

Absorbent cloth 320 may comprise any suitable absorbent cloth. As shown in the figures, absorbent cloth 320 includes front surface 319 and may be substantially rectangular. If rectangular, absorbent cloth 320 generally comprises first upper corner region 323, second upper corner region 327, a first lower corner region (not shown), and a second lower corner region (not shown). In a preferred embodiment, first and/or second upper corner regions, 323 and/or 327, respectively, comprises hood 330. Hood 330 is operatively arranged to cover head 32 of infant 30. Absorbent cloth 320 is adapted to substantially cover and/or shield the front of the user's torso 54 when it is arranged hangingly from collar 350. This hanging arrangement also allows user 50 to keep both of her hands free while she is bathing infant 30.

Absorbent cloth 320 further comprises extension 370, which is adapted to rest on a shoulder of user 50. Extension 370 may be an extension of the material from which absorbent cloth 320 is made, or a separate piece of material fixedly secured to such material. Extension 370 forms aperture 360. Aperture 360 includes inner surface 361 and, as shown in this figure, is preferably arranged as a tube. In this embodiment, the tube may be formed by rolling the end of extension 370 over and stitching its edge to its back or front side.

Loop 352 comprises strap 355 extending from absorbent cloth 320 proximate a first side of the user's neck 52. Strap 355 includes first end 356 and outer surface 357. First end 356 is insertable in aperture 360. In this embodiment, the actuatable means for releasing loop 352 from around the user's neck 52 comprises a frictional engagement between outer surface 357 and inner surface 361, when first end 356 is arranged in aperture 360.

The aforementioned frictional engagement comprises a static friction sufficient to maintain the form of loop 352 around the user's neck 52 when absorbent cloth 320 hangs from collar 350 in front of the user's torso 54, but insufficient to maintain the form of loop 352 when absorbent cloth 320 is pulled in a direction away from the user's neck 52. Preferably, first end 356 is larger than aperture 360, in order to provide ample static friction to maintain the form of loop 352 around the user's neck 52.

Figure 8:
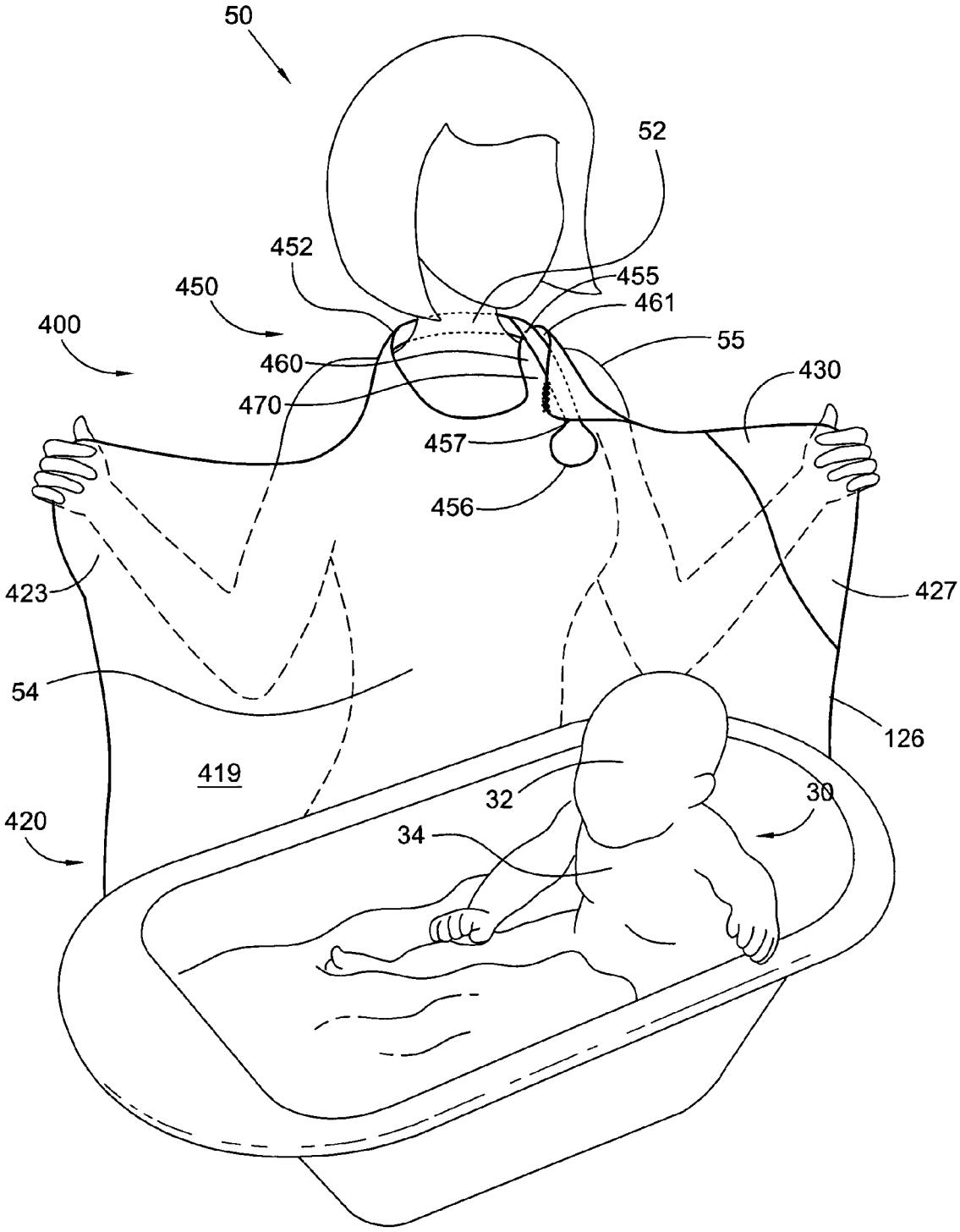
FIG. 8 is a front perspective view of a user displaying a fourth embodiment of the present invention bath towel bib while bathing an infant.

FIG. 8 is a front perspective view of user 50 displaying a fourth embodiment of the present invention bath towel bib, hereinafter referred to as bath towel bib 400. Bath towel bib 400 comprises collar 450 adapted to form releasably securable loop 452 around the user's neck 52, an actuatable means for releasing loop 452 from around the user's neck 52, and absorbent cloth 420 fixedly attached to collar 450. Absorbent cloth 420 is operatively arranged to hang from collar 450 in front of the user's torso 54 when loop 452 is releasably secured around the user's neck 52. The actuatable means for releasing loop 452 from around neck 52 is operatively arranged to actuate when absorbent cloth 420 is pulled in a direction away from the user's neck 52, similar to that which is shown in FIG. 5 and described in detail supra.

Absorbent cloth 420 may comprise any suitable absorbent cloth. As shown in the figures, absorbent cloth 420 includes front surface 419 and may be substantially rectangular. If rectangular, absorbent cloth 420 generally comprises first upper corner region 423, second upper corner region 427, a first lower corner region (not shown), and a second lower corner region (not shown). In a preferred embodiment, first and/or second upper corner regions, 423 and/or 427, respectively, comprises hood 430. Hood 430 is operatively arranged to cover head 32 of infant 30. Absorbent cloth 420 is adapted to substantially cover and/or shield the front of the user's torso 54 when it is arranged hangingly from collar 450. This hanging arrangement also allows user 50 to keep both of her hands free while she is bathing infant 30.

Absorbent cloth 420 further comprises extension 470, which is adapted to rest on a shoulder of user 50. Extension 470 may be an extension of the material from which absorbent cloth 420 is made, or a separate piece of material fixedly secured to such material. Extension 470 forms aperture 460. Aperture 460 includes inner surface 461 and, as shown in this figure, is preferably arranged as a tube. In this embodiment, the tube may be formed by folding a portion of extension 470 over and stitching its edge to its back or front side. In one embodiment, the portion of extension 470 which is folded over and stitched, is also arranged to form hood 430.

Loop 452 comprises strap 455 extending from absorbent cloth 420 proximate a first side of the user's neck 52. Strap 455 includes first end 456 and outer surface 457. First end 456 is insertable in aperture 460. In this embodiment, the actuatable means for releasing loop 452 from around the user's neck 52 comprises a frictional engagement between outer surface 457 and inner surface 461, when first end 456 is arranged in aperture 460.

The aforementioned frictional engagement comprises a static friction sufficient to maintain the form of loop 452 around the user's neck 52 when absorbent cloth 420 hangs from collar 450 in front of the user's torso 54, but insufficient to maintain the form of loop 452 when absorbent cloth 420 is pulled in a direction away from the user's neck 52. Preferably, first end 456 is larger than aperture 460, in order to provide ample static friction to maintain the form of loop 452 around the user's neck 52.

Figure 9:
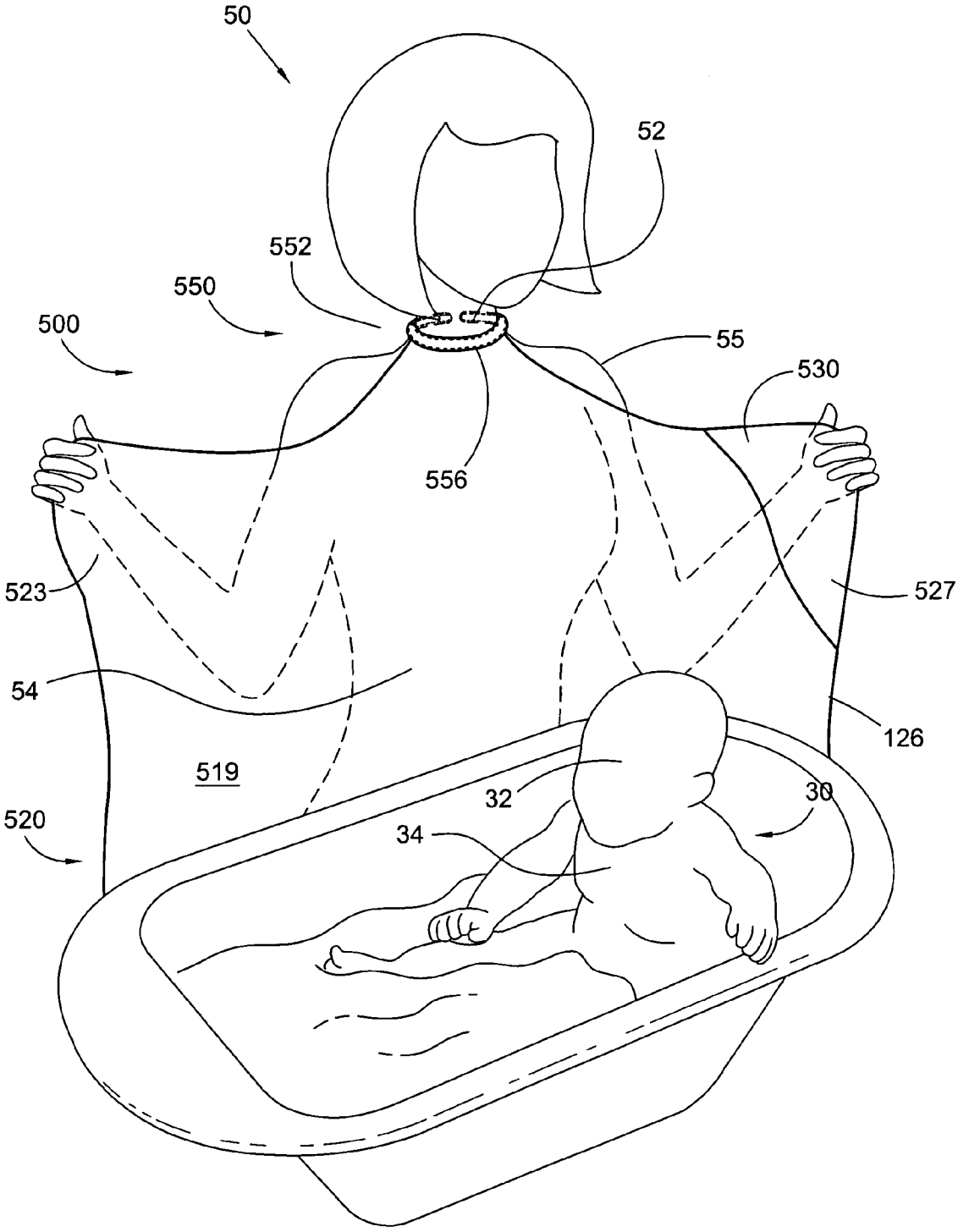
FIG. 9 is a front perspective view of a user displaying a fifth embodiment of the present invention bath towel bib while bathing an infant; and, FIG. 10 is a front perspective view of a user displaying a sixth embodiment of the present invention bath towel bib while bathing an infant.

FIG. 9 is a front perspective view of user 50 displaying a fifth embodiment of the present invention bath towel bib, hereinafter referred to as bath towel bib 500. Bath towel bib 500 comprises collar 550 adapted to form releasably securable loop 552 around the user's neck 52, an actuatable means for releasing loop 552 from around the user's neck 52, and absorbent cloth 520 fixedly attached to collar 550. Absorbent cloth 520 is operatively arranged to hang from collar 550 in front of the user's torso 54 when loop 552 is releasably secured around the user's neck 52. The actuatable means for releasing loop 552 from around neck 52 is operatively arranged to actuate when absorbent cloth 520 is pulled in a direction away from the user's neck 52, similar to that which is shown in FIG. 5 and described in detail supra.

Absorbent cloth 520 may comprise any suitable absorbent cloth. As shown in the figures, absorbent cloth 520 includes front surface 519 and may be substantially rectangular. If rectangular, absorbent cloth 520 generally comprises first upper corner region 523, second upper corner region 527, a first lower corner region (not shown), and a second lower corner region (not shown). In a preferred embodiment, first and/or second upper corner regions, 523 and/or 527, respectively, comprises hood 530. Hood 530 is operatively arranged to cover head 32 of infant 30. Absorbent cloth 520 is adapted to substantially cover and/or shield the front of the user's torso 54 when it is arranged hangingly from collar 550. This hanging arrangement also allows user 50 to keep both of her hands free while she is bathing infant 30.

Loop 552 loop is in the form of C-shaped band 555 (shown in hatched lines), which comprises an elastic material. Hereinafter, a material is considered to be elastic if it deforms under stress (e.g., external forces), but returns to its original shape when the stress is removed. Band 555 extends from absorbent cloth 520 and is adapted to substantially surround the user's neck 52. In a preferred embodiment, band 555 is at least partially encased in semi-toroidal cloth 556, which serves as a means for securing band 555 to absorbent cloth 520, and provides soft engagement between the user's neck 52 and collar 550.

In this embodiment, the actuatable means for releasing loop 552 from around the user's neck 52 comprises the elasticity of the material band 555, wherein the elasticity is sufficient to maintain the form of loop 552 when absorbent cloth 520 hangs from collar 550 in front of the user's torso 54, but insufficient to maintain the form of loop 552 when absorbent cloth 520 is pulled in a direction away from the user's neck 52. Accordingly, band 555 may comprise any suitable elastic material, such as, plastic, rubber, etc.

Figure 10:
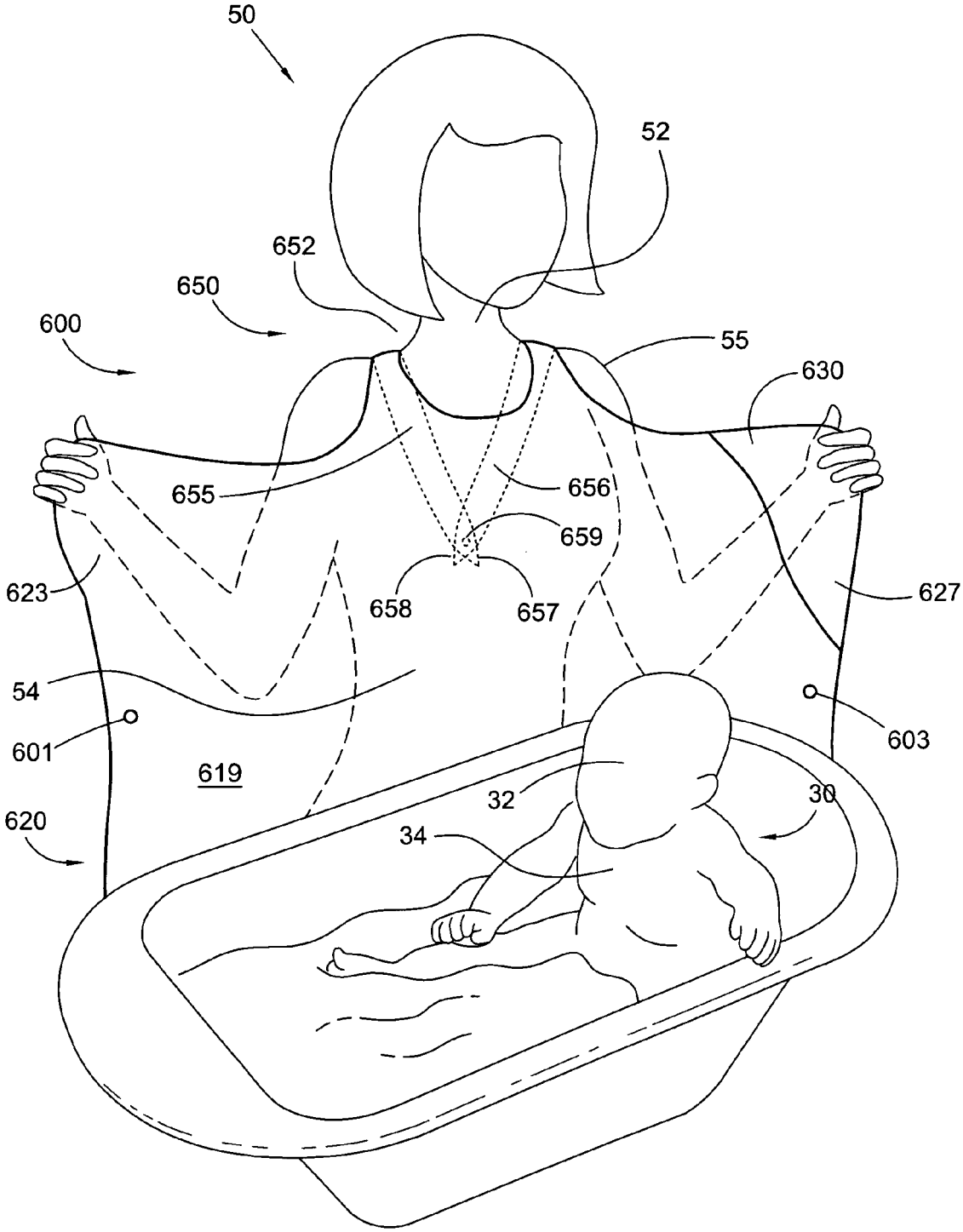

FIG. 10 is a front perspective view of user 50 displaying a sixth embodiment of the present invention bath towel bib, hereinafter referred to as bath towel bib 600. Bath towel bib 600 comprises collar 650 adapted to form releasably securable loop 652 around the user's neck 52, an actuatable means for releasing loop 652 from around the user's neck 52, and absorbent cloth 620 fixedly attached to collar 650. Absorbent cloth 620 is operatively arranged to hang from collar 650 in front of the user's torso 54 when loop 652 is releasably secured around the user's neck 52. The actuatable means for releasing loop 652 from around neck 52 is operatively arranged to actuate when absorbent cloth 620 is pulled in a direction away from the user's neck 52, similar to that which is shown in FIG. 5 and described in detail supra.

Absorbent cloth 620 may comprise any suitable absorbent cloth. As shown in the figures, absorbent cloth 620 includes front surface 619 and may be substantially rectangular. If rectangular, absorbent cloth 620 generally comprises first upper corner region 623, second upper corner region 627, a first lower corner region (not shown), and a second lower corner region (not shown). In a preferred embodiment, first and/or second upper corner regions, 623 and/or 627, respectively, comprises hood 630. Hood 630 is operatively arranged to cover head 32 of infant 30. Absorbent cloth 620 is adapted to substantially cover and/or shield the front of the user's torso 54 when it is arranged hangingly from collar 650. This hanging arrangement also allows user 50 to keep both of her hands free while she is bathing infant 30.

Loop 652 comprises first strap 655 extending from absorbent cloth 620, first strap 655 having first end 657, and second strap 656 extending from absorbent cloth 620, second strap 656 having second end 658. First end 657 and second end 658 are releasably securable to each other.

In this embodiment, the actuatable means for releasing loop 652 from around the user's neck 52 comprises means 699 for releasably securing first end 657 to second end 658. Means 659 may be any suitable means in the art, such as, a first magnet fixedly secured to first end 657 and a second magnet fixedly secured to second end 658, wherein the first magnet and the second magnets are magnetically attracted to each other. Alternatively, means 659 may comprise hook-and-loop fasteners, of which first end 657 comprises a hook side and second end 658 comprises a loop side.

It is contemplated that the present invention bath towel bib would be well-suited for use in bathing an animal, such as, a dog. To that end, the bath towel bib may include means for fastening the absorbent cloth around an animal. For example, bath towel bib 600 is shown comprising third magnet 601 and fourth magnet 603, wherein third magnet 601 and fourth magnet 603 are magnetically attracted to each other. In such an embodiment, absorbent cloth 620 may be adapted to circumscribe the body of a four-legged animal, and the user could secure the cloth to the animal's body by attaching magnets 601 and 603 to each other. Additionally, first strap 655 and second strap 656 may be adapted to fit around and secure to the animal's neck.

Thus, it is seen that the objects of the present invention are efficiently obtained, although modifications and changes to the invention should be readily apparent to those having ordinary skill in the art, which modifications are intended to be within the spirit and scope of the invention as claimed. It also is understood that the foregoing description is illustrative of the present invention and should not be considered as limiting. Therefore, other embodiments of the present invention are possible without departing from the spirit and scope of the present invention.

I claim:

1. A bath towel bib comprising:

a collar adapted to form a releasably securable loop around a user's neck;

an actuatable means for releasing the loop from around the user's neck;

an absorbent cloth fixedly attached to the collar and operatively arranged to hang from the collar in front of the user's torso when the loop is releasably secured around the user's neck, wherein the actuatable means for releasing the loop from around the user's neck is operatively arranged to actuate when the absorbent cloth is pulled in a direction away from the user's neck; and, a first aperture having a first inner surface, wherein the loop comprises a first strap extending from the absorbent cloth proximate a first side of the user's neck, the first strap having a first end and an outer surface, the first end is insertable in the first aperture, and the actuatable means for releasing the loop from around the user's neck comprises a first frictional engagement between the outer surface and the first inner surface when the first end is arranged in the first aperture wherein the first frictional engagement comprises a static friction sufficient to maintain the form of the loop when the absorbent cloth hangs from the collar in front of the user's torso, but insufficient to maintain the form of the loop when the absorbent cloth is pulled in a direction away from the user's neck, wherein the first end of the first strap is larger than the first aperture.

2. A bath towel bib comprising:

a collar adapted to form a releasably securable loop around a user's neck;

an actuatable means for releasing the loop from around the user's neck;

an absorbent cloth fixedly attached to the collar and operatively arranged to hang from the collar in front of the user's torso when the loop is releasably secured around the user's neck, wherein the actuatable means for releasing the loop from around the user's neck is operatively arranged to actuate when the absorbent cloth is pulled in a direction away from the user's neck; and, a first aperture having a first inner surface, wherein the loop comprises a first strap extending from the absorbent cloth proximate a first side of the user's neck, the first strap having a first end and an outer surface, the first end is insertable in the first aperture, and the actuatable means for releasing the loop from around the user's neck comprises a first frictional engagement between the outer surface and the first inner surface when the first end is arranged in the first aperture, wherein the first frictional engagement comprises a static friction sufficient to maintain the form of the loop when the absorbent cloth hangs from the collar in front of the user's torso, but insufficient to maintain the form of the loop when the absorbent cloth is pulled in a direction away from the user's neck, wherein the first aperture is arranged on the absorbent cloth, the absorbent cloth comprises an extension adapted to rest on a shoulder of the user, and wherein the extension forms a second aperture having a second inner surface, wherein the first end is insertable in the second aperture, and the actuatable means for releasing the loop from around the user's neck further comprises a second frictional engagement between the outer surface of the strap and the second inner surface of the second aperture when the first end is inserted in the second aperture.

3. The bath towel bib as recited in claim 2 wherein the second aperture is arranged as a tube.

4. The bath towel bib recited in claim 3 wherein the tube is in the form of at least two flaps folded over and secured to each other.

5. A bath towel bib comprising:

a collar adapted to form a releasably securable loop around a user's neck, the collar comprising a first strap having a first end and an outer surface;

an absorbent cloth fixedly attached to the collar and operatively arranged to hang from the collar in front of the user's torso when the loop is releasably secured around the user's neck, wherein the first strap extends from the absorbent material proximate a first side of the user's neck; and, a first aperture having a first inner surface, wherein the first end is insertable in the first aperture, and a first frictional engagement is formed between the outer surface and the first inner surface when the first end is arranged in the first aperture, and wherein the first frictional engagement comprises a static friction sufficient to maintain the form of the loop when the absorbent cloth hangs from the collar in front of the user's torso, but insufficient to maintain the form of the loop when the absorbent cloth is pulled in a direction away from the user's neck, and wherein the first end of the first strap is larger than the first aperture.

6. The bath towel bib recited in claim 5 wherein the first aperture is arranged on the absorbent cloth.

7. The bath towel bib recited in claim 5 wherein the absorbent cloth comprises an extension adapted to rest on a shoulder of the user, wherein the extension forms a second aperture having a second inner surface, wherein the first end is insertable in the second aperture, and the actuatable means for releasing the loop from around the user's neck further comprises a second frictional engagement between the outer surface of the strap and the second inner surface of the second aperture when the first end is inserted in the second aperture.

8. The bath towel bib as recited in claim 7 wherein the second aperture is arranged as a tube, and the tube is in the form of at least two flaps folded over and secured to each other.

* * * * *